US005271184A

United States Patent [19]

Majors

[11] Patent Number: 5,271,184

[45] Date of Patent: Dec. 21, 1993

[54] VIBRATORY FINISHING APPARATUS FOR HOLLOW CYLINDRICAL AND OTHER LARGE OR GROUPINGS OF ARTICLES

[76] Inventor: Curtis O. Majors, 7918 Winterberry Pl., Cincinnati, Ohio 45241

[21] Appl. No.: 879,202

[22] Filed: May 6, 1992

[51] Int. Cl.[5] ..... B24B 31/06

[52] U.S. Cl. ..... 51/7; 51/19; 51/163.1

[58] Field of Search ..... 51/313, 163.1, 7, 17, 51/19, 163.2

[56] References Cited

U.S. PATENT DOCUMENTS

| | | | |
|---|---|---|---|
| 713,379 | 11/1902 | Barton . | |
| 2,509,041 | 5/1950 | Lubenow . | |
| 3,128,577 | 4/1964 | Guibert et al. . | |
| 3,333,367 | 8/1967 | Salvaire . | |
| 3,371,449 | 3/1968 | Olson et al. | 51/313 |
| 3,435,565 | 4/1969 | Blundell . | |
| 3,464,163 | 9/1969 | Ferrara | 51/163.1 |
| 3,599,374 | 8/1971 | Porter et al. . | |
| 3,924,357 | 12/1975 | Schmidt et al. . | |
| 4,706,414 | 11/1987 | Muzik | 51/163.1 |

FOREIGN PATENT DOCUMENTS

| | | | |
|---|---|---|---|
| 0483231 | 12/1975 | U.S.S.R. | 51/19 |

*Primary Examiner*—Robert A. Rose
*Attorney, Agent, or Firm*—Wood, Herron & Evans

[57] ABSTRACT

A vibratory finishing apparatus adapted to deburr cylindrical and other large articles or groupings of articles includes a vibrating vessel adapted to receive the cylindrical object. The cylindrical object is supported and rotated within the vibrating vessel. In particular, the article is supported by two shafts which run through holes in the side wall of the vibrating vessel. The shafts are rotated thereby rotating the cylindrical object within the vibrating medium. In a preferred embodiment, the vibrating medium generally flows in a first direction and the cylindrical object is rotated in a direction opposite the first direction.

3 Claims, 2 Drawing Sheets

VIBRATORY FINISHING APPARATUS FOR HOLLOW CYLINDRICAL AND OTHER LARGE OR GROUPINGS OF ARTICLES

BACKGROUND

Vibratory finishing has been used extensively to provide an exterior finish to various articles, particularly machining metal products and metal castings and the like. The part that is being finished is placed in a vibrating vessel partially filled with an abrasive medium. The vibration causes the medium to act on the exterior surface of the article and thus remove undesirable material, such as burrs, flash, and surface refinement for micro inch finishing and the like.

With hollow articles, this presents a different problem. The medium must come into contact with the interior surface of the hollow article in order to be effective. The abrasive material, of course, is relatively fluid, while the vessel is being vibrated. Therefore, the medium will flow around and through openings in objects submersed in the vibrating medium. However, with hollow cylindrical articles, this is not totally effective, particularly with, for example, the housing for the turbine of a jet engine. The housing is a hollow cylindrical article which has numerous holes and passageways around the housing.

Unfortunately, due to the physical configuration of this, and that fact that the holes lie within the wall of the hollow cylindrical article, normal vibrating finishing equipment will not adequately finish these articles. Simply immersing these in a vibrating medium has not proven to be effective.

As a result, these articles are finished by hand. This is particularly expensive, inefficient and creates inherent quality control problems.

SUMMARY OF THE INVENTION

Accordingly, it is an object of the present invention to provide a vibrating finishing apparatus and method effective to remove flashing and other unwanted material from the surface of hollow cylindrical large articles, such as the turbine housing for a jet engine and similar products.

Further, it is an object of the present invention to provide a finishing apparatus which is adapted to provide a vibrating vessel of abrasive material and apparatus to rotate and suspend an article which is being finished inside the abrasive medium.

It is further an object of the present invention to provide a vibrating vessel of abrasive medium which is supported, for example, by a plurality of springs in turn resting on a base. The structure which suspends and rotates the article does not contact the vibrating vessel itself.

These objects and advantages are provided by a finishing apparatus which includes a non-vibrating base. A vessel such as a tub or bowl is supported on the base on a plurality of springs and vibrated. Also supported on the base are two shafts that extend through holes in the side walls of the vibrating vessel. The holes in the vessel allow these shafts to extend into the vessel without contacting the vessel itself.

The part which is being finished is mounted to these shafts, which are driven by a motor also mounted on the base. Since the drive motor and bearings supporting the shafts are all supported by the base, they do not vibrate. This allows the workpiece to be suspended in the vessel of abrasive medium and rotated within the medium so that as the medium is vibrated within the vessel, the article itself is rotated and acted on by the abrasive medium. In a preferred embodiment, the vessel is a U-shaped vessel having two planar side walls with the shafts which hold the cylindrical object extending through either of the side walls.

The invention is particularly suited to finishing large cylindrical objects. However, it can be used advantageously to finish any article which can be supported in the apparatus of the present invention.

The objects and advantages of the present invention will be further appreciated in light of the following detailed description and drawings in which:

DETAILED DESCRIPTION

Figure 1:
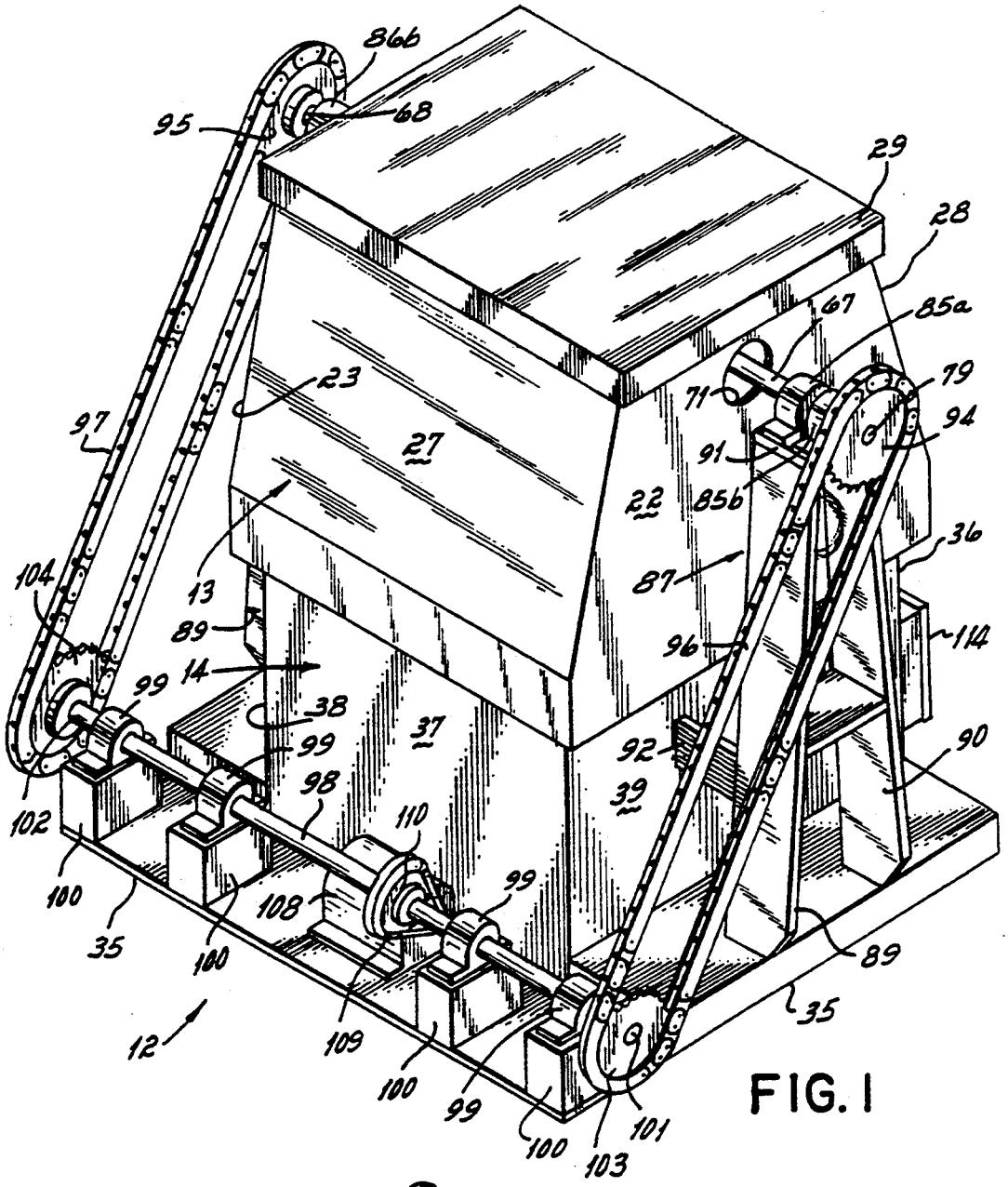
FIG. 1 is a rear perspective view of the present invention.

The present invention is designed to deburr large objects 10, particularly those which have numerous holes 11 along the side wall of the object. An exemplary object is the compressor housing for a jet engine. These are large cylindrical objects which have numerous ports throughout the side walls which must be accurately cast to permit assembly of the jet engine.

The finishing apparatus 12 used to deburr such turbine housings includes a vessel or tub portion 13 and a base 14. The tub portion 13 is supported on the base on a plurality of springs 15. The tub portion 13 is then vibrated by a vibrating mechanism 16 which causes a medium 17 in the tub 13 to move or vibrate and act on the object 10 which is supported in the tub.

More particularly, the tub portion 13 includes a floor or base 21 and side walls 22, 23. Between side walls 22 and 23 is a U-shaped tub wall 26 welded to side walls 22 and 23. Side walls 27 and 28 along side the U-shaped tub wall 26 provide added structural support for tub portion 13. On top of tub portion 13 is a cover 29.

Extended from the side wall 22 is a media drain port 31 which includes a door or plug (not shown). These doors are typically a cylindrical piece of polyurethane with metal plates on either side which are compressed together by a nut and bolt to laterally expand the polyurethane and plug up the hole.

The base 14 includes a bottom wall or floor 35 and four side walls 36, 37, 38 and 39, respectively. Cantilevered brackets 41 are welded to the front and rear walls 36, 37 and support the springs 15 in spring collars 43. Likewise, the springs 15 rest in spring collars 32 which are welded to the floor or base 21 of tub portion 13.

Vibration of the tub portion 13 relative to base 14 is caused by the vibrating generating mechanism 16 which is also commonly referred to as an unbalanced drive shaft assembly. The unbalanced drive shaft assembly 16 is driven by a motor 45 which is mounted to the base 35. Motor 45 drives a sheave 46 which drives belt 47, in turn driving a second sheave 48 mounted to the unbalanced drive shaft assembly 16.

The unbalanced drive shaft assembly includes a bearing housing 54 which is supported by a first and second rounded V-shaped plates (saddle housings) 52 and 53, which are welded to base 21 of tub portion 13 and bolted to the bearing housing.

The bearing housing supports a central shaft 51 which includes two distal weights, first weight 55 and second weight 56. As shown, these are in alignment, although for particular application they can be fan-tailed. The central shaft 51 is driven by sheave 48. Since the V-shaped plate or saddle housings 52 and 53 are welded to the base 21 of tub portion 13, the tub portion will vibrate as weights 56 and 57 rotate.

Figure 4:
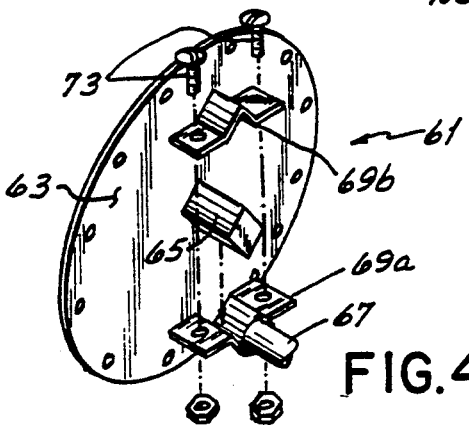
FIG. 4 is a perspective view of the support jig used in the present invention.
Figure 3:
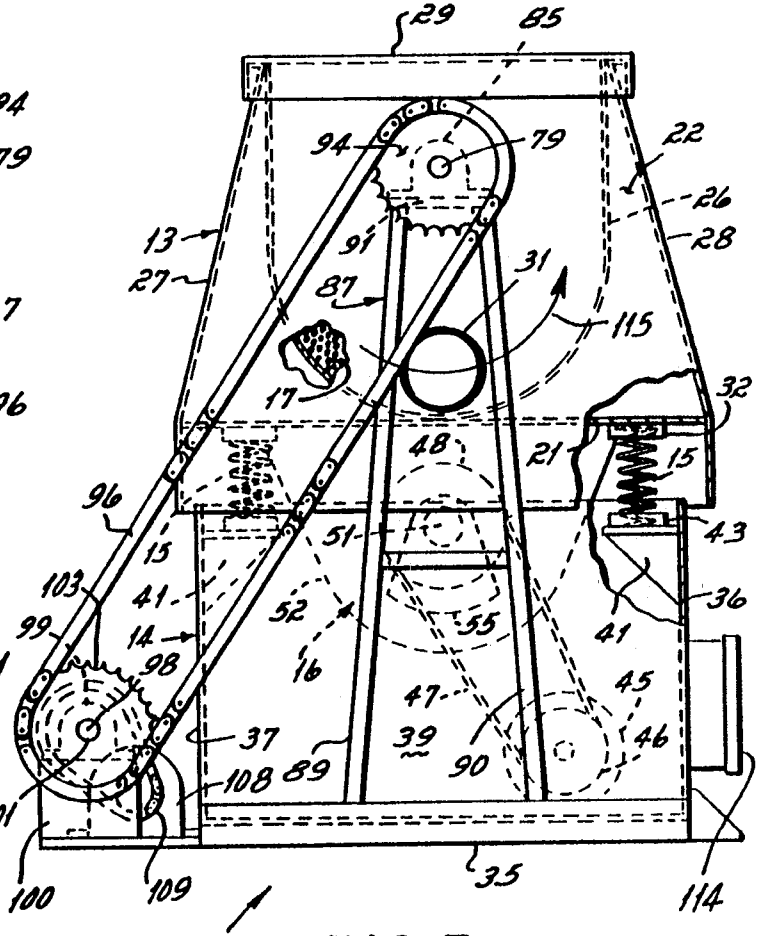
FIG. 3 is an end view thereof, partially broken away.
Figure 2:
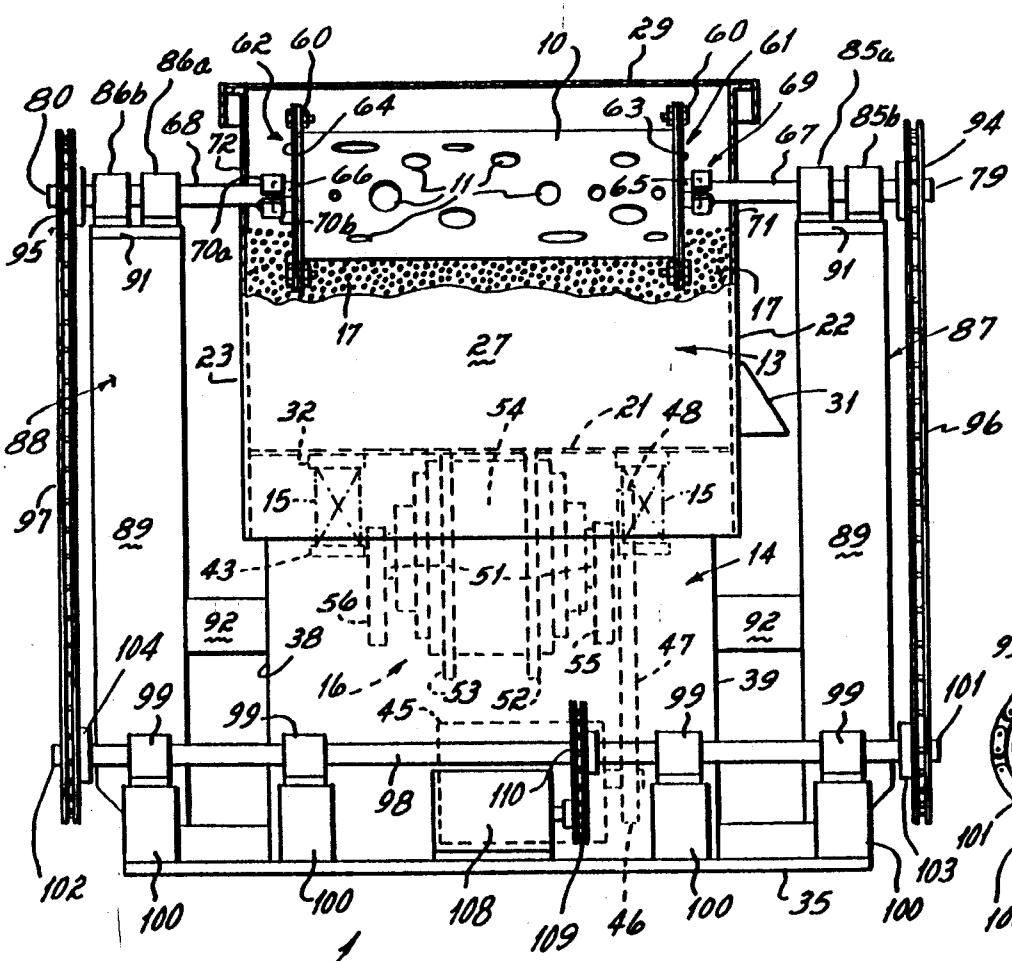
FIG. 2 is a rear view thereof, partially broken away.

The cylindrical object 10 is supported in the abrasive media 17 in tub 13 by a first and second jig 61 and 62. The jigs are formed from round plates 63 and 64. The center of each plate includes a square drive dog 65 and 66, respectively. These drive dogs are driven by shafts 67 and 68. As shown in FIG. 4, one end of each shaft includes a rectangular collar. The collars 69 and 70 each includes a generally V-shaped portion 69*a* welded to the shaft and an upper V-shaped portion 69*b* which is loose. The two portions 69*a* and 69*b* are bolted together by bolts 73 to form the collar. Collars 69 and 70 are both mirror images and only collar 69 is described herein.

The jigs 61 and 62 are fixed to end walls of the cylindrical object 10 by bolts 6 extending through a flange on the cylindrical object 10 and through the plates 63 and 64. Other means of attachment can be used depending on the object being treated.

Shafts 67 and 68 each extend through holes 71 and 72 in side walls 22 and 23. These holes are of a size that shafts 67 and 68 do not contact side walls 22 or 23 as tub 13 is vibrated. The opposite ends 79 and 80 of shafts 67 and 68 are each supported by bearings 85*a*, 85*b* and and 86*a*, 86*b*. These bearings rest on the top surface 91 of supports 87 and 88.

Supports 87 and 88 each include first and second legs 89, 90 which are supported by floor 35 and anchored by braces 92 to the base portion 14.

Ends 79 and 80 of shafts 67 and 68 include drive sprockets 94 and 95, which are in turn driven by chains 96 and 97, which are in turn driven by a main drive shaft 98.

The main drive shaft 98 rides in four bearings 99 which are supported on four blocks 100, each resting on the floor 35 of base portion 14. At ends 101 and 102 are drive sprockets 103 and 104, which in turn drive chains 96 and 97.

Finally, the main drive shaft is itself driven by a drive motor 108 which is supported on floor 35. Drive motor 108 drives chain 109, which in turn drives sprocket 110 which is fixed to the main drive shaft.

The motor is generally at 2–7 horsepower and variable speed drive, and preferably a 3–5 horsepower motor, depending on the object being treated. Likewise, motor 46 will vary depending upon the size of the object and the apparatus used.

Both motors are operated from a control panel 114 which will control the speed of motor 45, as well as the speed of motor 108, the duration of the treatment cycle, and any other factors involved.

The present invention is practiced by placing the medium 17 in tub 13 up to the desired level, but below holes 71 and 72. The object 10 is then bolted to plates 63 and 64. Shafts 67 and 68 extend through the holes 71 and 72 in side walls 38 and 39. The top portions 69*b*, 70*b* of the collars 69 and 70 are removed so that the object can be lowered into the tub with the drive dog 65 and 66 resting into the bottom portions 69*a*, 70*a* of collars 69 and 70. The top portions are bolted to the bottom portion fixing the plates 63 and 64 and object 10 to the shafts 67 and 68.

The unbalanced drive shaft assembly motor 45 would then be activated which would cause the medium to vibrate and flow in a generally cylindrical pattern around the short axis of the machine as shown by arrow 115. Next, motor 108 would be turned on to cause the cylindrical object to rotate in the direction opposite arrow 115. This would be continued for a period of time until the object 10 was adequately deburred or the surface reaches the desired finish which can vary depending on the metal the object is made from, as well as the media used. In this application, a variety of media could be used including plastic media, ceramic media, all of which are well known to those skilled in the art. Accordingly, this enables one to remove flashing and burrs and other unwanted material from relatively intricate openings such as those in the wall of a cylindrical object as well as others. This is particularly beneficial in the treatment or deburring of the turbine housing for a jet engine. This significantly reduces the treatment time for these and changes what previously was a very labor intensive operation to a nonlabor intensive operation. This in turn significantly reduces cost.

This has been a description of the present invention along with the preferred method of practicing the present invention.

Accordingly, the present invention should be defined only by the appended claims wherein we claim:

1. An apparatus for finishing an article comprising:

a vessel adapted to receive abrasive medium;

means to vibrate said vessel;

means to support and rotate said article in said medium;

wherein said means to support and rotate said article comprises at least a first shaft extending through an opening in a first wall of said vessel, a second shaft extending through a second opening in a second wall of said vessel, said first and second shaft spaced from said openings so that it does not contact the wall of the vessel as it vibrates wherein said first and second shafts are rotated by a motor mounted on a base whereby said motor is not vibrated as said vessel is vibrated wherein said motor mounted on said base drives two drive sprockets, one each of said drive sprockets driving one of said first and second shaft, respectively, and wherein said shafts are mounted to supports in turn mounted on said base whereby said shafts are not vibrated as said vessel vibrates.

2. The apparatus claimed in claim 1 wherein said vessel is a generally U-shaped tub and said first and second walls comprise planar U-shaped plates connected to distal ends of a third arcuate wall.

3. The apparatus claimed in claim 1 wherein said tub is mounted on said base by a plurality of springs to permit said tub to vibrate relative to said base, wherein said means to vibrate said vessel is connected to said vessel wherein said first and second shafts are mounted to said base.

* * * * *